US006811060B2

(12) United States Patent
Petit

(10) Patent No.: US 6,811,060 B2
(45) Date of Patent: Nov. 2, 2004

(54) FLUID PRODUCT DISPENSING PUMP

(75) Inventor: Ludovic Petit, Vitot (FR)

(73) Assignee: Valois S.A.S., Le Neubourg (FR)

( * ) Notice: Subject to any disclaimer, the term of this patent is extended or adjusted under 35 U.S.C. 154(b) by 35 days.

(21) Appl. No.: 10/381,982

(22) PCT Filed: Oct. 19, 2001

(86) PCT No.: PCT/FR01/03257

§ 371 (c)(1),
(2), (4) Date: Apr. 1, 2003

(87) PCT Pub. No.: WO02/34413

PCT Pub. Date: May 2, 2002

(65) Prior Publication Data

US 2004/0011823 A1 Jan. 22, 2004

(30) Foreign Application Priority Data

Oct. 23, 2000 (FR) ..... 00 13569

(51) Int. Cl.[7] ..... B67D 5/40
(52) U.S. Cl. ..... 222/321.2; 222/321.9
(58) Field of Search ..... 222/321.1, 321.2, 222/321.7, 321.9, 380

(56) References Cited

U.S. PATENT DOCUMENTS 5,092,495 A * 3/1992 Andre ..... 222/341
5,303,854 A 4/1994 Cater
6,302,304 B1 * 10/2001 Spencer ..... 222/260
6,698,623 B2 * 3/2004 Petit ..... 222/153.12

FOREIGN PATENT DOCUMENTS

FR 1486392 6/1967

* cited by examiner

*Primary Examiner*—Joseph A. Kaufman
(74) *Attorney, Agent, or Firm*—Sughrue Mion, PLLC

(57) ABSTRACT

A fluid dispenser pump comprising a pump body (10) containing a pump chamber (11) defined between an upper piston (20) and a lower piston (30), the pistons (20, 30) being mounted to slide in leaktight manner in the pump body (10), the pump chamber (11) being provided with an inlet valve (40) and with an outlet valve (50), the lower piston (30) co-operating with the outlet valve (50), when the full dose has been metered out, to open the outlet valve and to make it possible to deliver the fluid contained in the pump chamber (11), the dispenser pump being characterized in that the lower piston (30) is separate from the inlet valve seat (42) and is mounted to float in the pump chamber (11), the lower piston (30) being returned to its rest position by the inlet valve seat (42).

8 Claims, 3 Drawing Sheets

FLUID PRODUCT DISPENSING PUMP

The present invention relates to a fluid dispenser pump.

Fluid dispenser pumps are well known from the state of the art. Such a pump generally comprises a pump body which defines a pump chamber disposed between an inlet valve and an outlet valve, with a piston sliding in said pump body to deliver fluid contained in said pump chamber. In certain cases, the pump can have two pistons, namely an upper piston and a lower piston, which pistons slide together in the pump body while it is being actuated, until the outlet valve opens and the fluid contained in the pump chamber is delivered.

In certain cases, in particular with pharmaceuticals, dose-metering accuracy and guaranteed dispensing of a full dose each time the pump is actuated can be essential criteria. In particular, it is important to prevent incomplete doses from being dispensed, and to prevent the pump chamber from being filled in part only after said pump has been actuated.

An object of the present invention is to provide a fluid dispenser pump that guarantees dose-metering accuracy each time the pump is actuated, and that guarantees a full dose is dispensed.

Another object of the present invention is to provide such a fluid dispensing pump that is simple and inexpensive to manufacture and to assemble.

To these ends, the present invention provides a fluid dispenser pump comprising a pump body containing a pump chamber defined between an upper piston and a lower piston, said pistons being mounted to slide in leaktight manner in said pump body, said pump chamber being provided with an inlet valve and with an outlet valve, said lower piston co-operating with said outlet valve, when a full dose has been metered out, to open said outlet valve and to make it possible to deliver the fluid contained in the pump chamber, said dispenser pump being characterized in that the lower piston is separate from the inlet valve seat and is mounted to float in the pump chamber, said lower piston being returned to its rest position by said inlet valve seat.

Advantageously, the outlet valve comprises a valve member which is mounted to move in the pump chamber and which is urged into its closure position by pressure from the fluid contained in the pump chamber, said moving valve member being provided with a shoulder which, when a full dose has been metered out, co-operates with said lower piston or with an element integral therewith, so that the lower piston lifts the valve member off its valve seat so as to open the outlet valve.

Advantageously, the outside diameter of the upper piston is larger than the outside diameter of the lower piston.

Advantageously, the valve seat of the inlet valve is urged by a resilient element such as a spring into the rest position of the pump, in which position said lower piston or an element integral therewith urges the outlet valve into its closure position.

Advantageously, the lower piston acts as a primer element for removing the air contained in the pump chamber when the pump is actuated for the first time.

Advantageously, when the pump chamber contains air, an air removal passageway is formed between the lower piston, the upper piston and the inlet valve seat so as to enable the air to be removed from the pump chamber, said lower piston closing off said air passageway in leaktight manner when the pump chamber contains fluid to be dispensed.

Advantageously, the outlet valve member is provided with a second shoulder which co-operates with said lower piston or with an element integral with said lower piston, when the pump is in the rest position, so that the lower piston urges said moving valve member into its closure position.

Other characteristics and advantages of the present invention will appear more clearly on reading the following detailed description given with reference to the accompanying drawings which are given by way of non-limiting example and in which.

Figure 1:
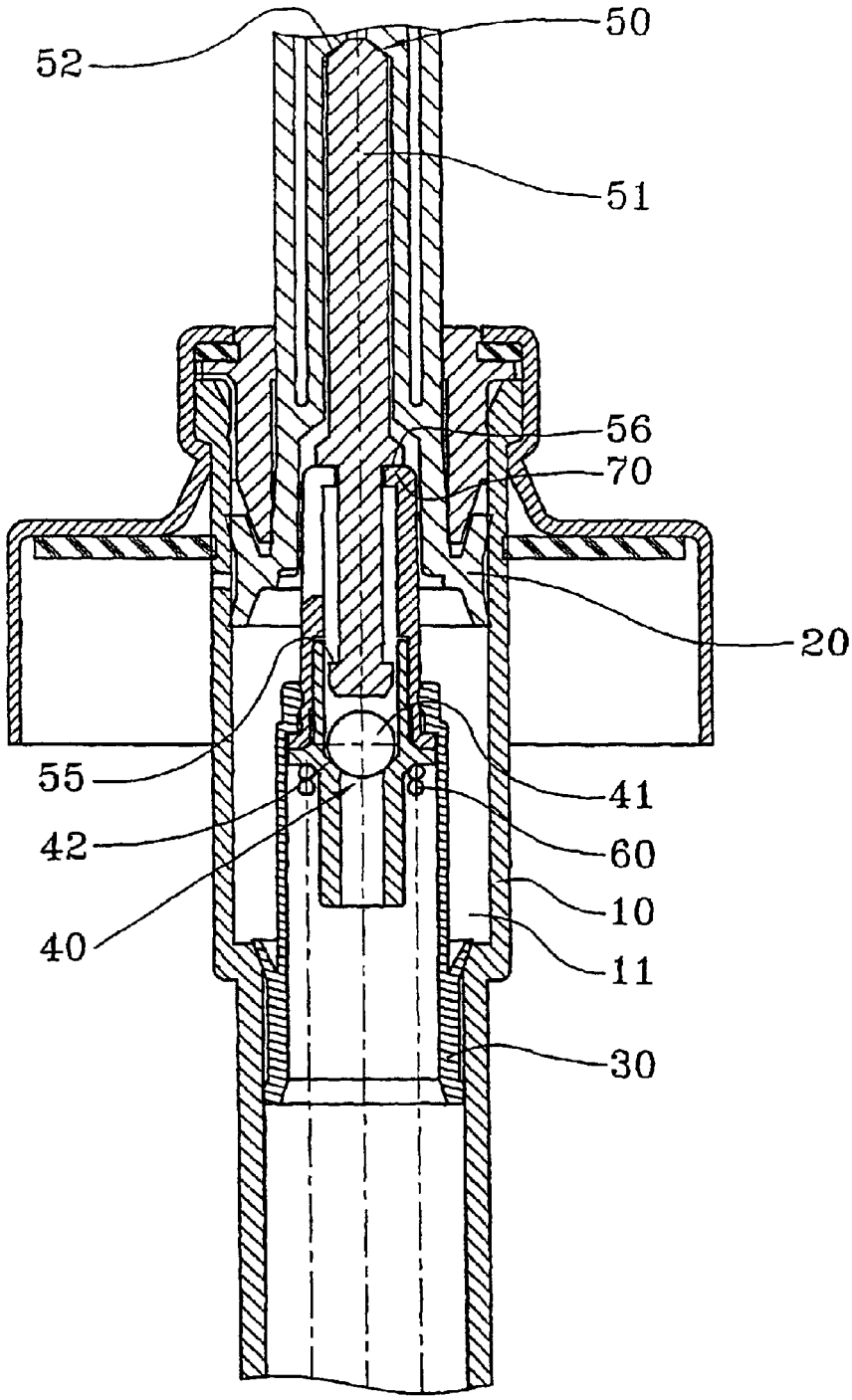
FIG. 1 is a diagrammatic section view of a pump of an advantageous embodiment of the present invention, in the rest position.

With reference to the figures, the pump comprises a pump body 10 in which an upper piston 20 and a lower piston 30 are mounted to slide in leaktight manner. Between said pistons 20 and 30 a pump chamber 11 is defined that is provided with an inlet valve 40 and with an outlet valve 50. The inlet valve 40 may be a ball valve comprising a ball 41 co-operating with a corresponding valve seat 42. When the user actuates the pump, the two pistons 20 and 30 slide inside the pump body while closing the inlet valve 40 until the outlet valve 50 opens to enable the fluid to be delivered.

In the invention, the lower piston 30, or an element 70 integral therewith, co-operates with the outlet valve 50 to open it when a full dose has been metered out. A dose might not be metered out in full until the end of the actuating stroke of the lower piston 30, but it is also possible for a full dose to be metered out before said end of the actuating stroke. In which case, the outlet valve 50 opens before the lower piston has traveled over its full stroke. In particular, in the example shown in the figures, the outlet valve 50 includes a moving outlet valve member 51 which is mounted to move axially inside the pump chamber 11, said moving valve member 51 being urged into its closed position, in which it presses against its valve seat 52, by the pressure from the fluid disposed inside the pump chamber 11. This implementation guarantees excellent leaktightness at the outlet valve, because it is impossible for said outlet valve to open in undesired manner before the fluid is delivered. Said valve member 51 is advantageously provided with a first shoulder 55 which co-operates with the lower piston 30 or with an element 70 integral with said lower piston 30, when the full dose has been metered out, so that the lower piston 30 mechanically lifts the valve member 51 off its valve seat 52 so as to open the outlet valve 50. Advantageously, the moving valve member 51 of the outlet valve 50 is also provided with a second shoulder 56 which co-operates with the lower piston 30 or with an element 70 integral therewith, when the pump is in the rest position, so that the moving valve member 51 is urged towards it closed position.

Operation of the pump is described below with reference to FIGS. 1 and 3.

In FIG. 1, the pump is in the rest position. When the user actuates the pump, said user exerts axial pressure on the upper piston 20 which then slides inside the pump body 10. Since the fluid contained in the pump chamber 11 is incompressible, said fluid also causes the lower piston 30 to slide in leaktight manner inside the pump body 10. The inlet valve 40 is urged into its closed position by the pressure from the fluid inside the pump chamber, and the same applies for the outlet valve 50, whose moving valve member 51 is also urged into its closed position by the pressure from the fluid inside the pump chamber 11.

Figure 3:
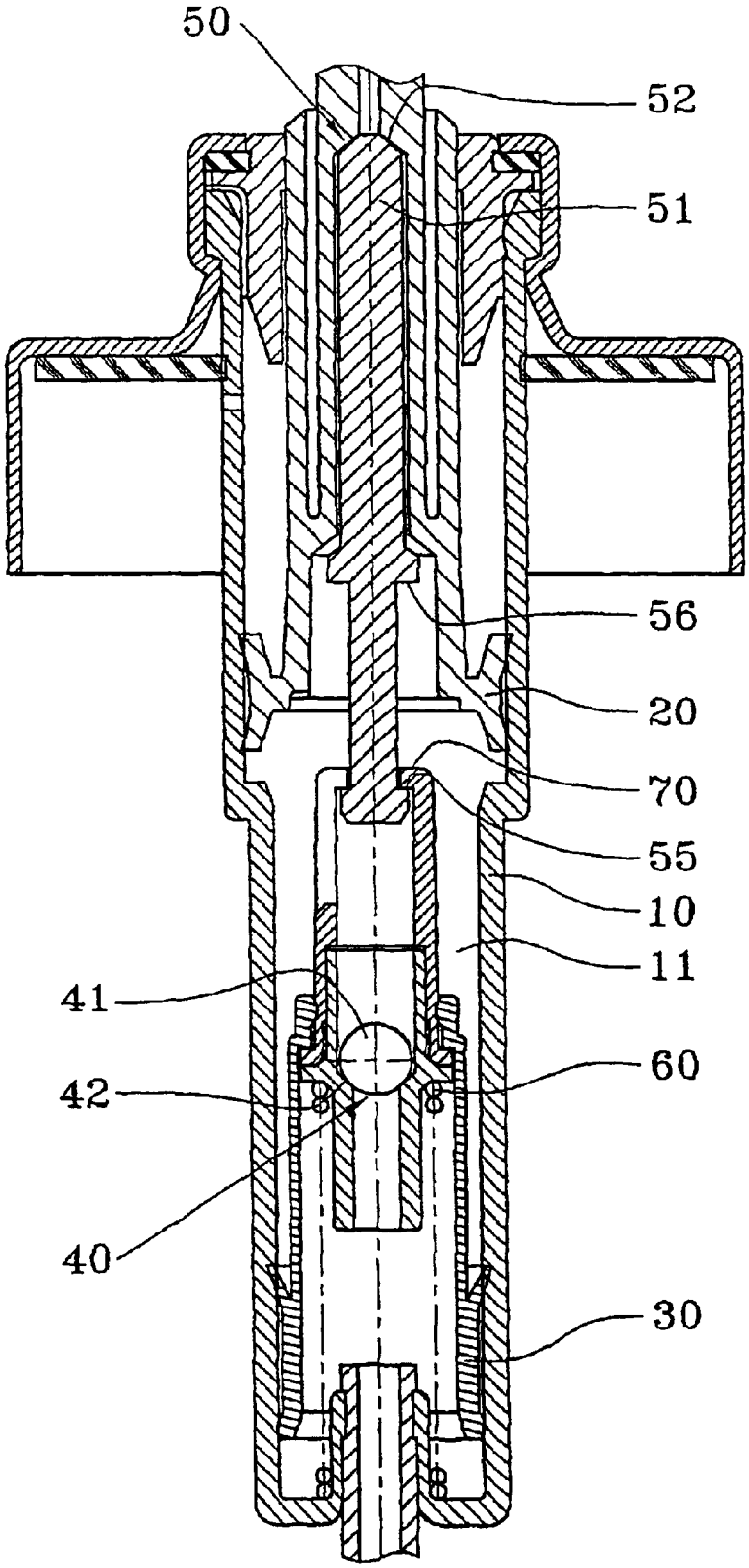
FIG. 3 is a view similar to the view in FIGS. 1 and 2, just before the fluid contained in the pump chamber is delivered.

When a full dose has been metered out, the position shown in FIG. 3 is reached. Since the diameter of the lower piston 30 is smaller than the diameter of the upper piston 20, the lower piston 30 or the element that is integral with the lower piston 30 and that is referenced 70 in the figures, moves faster than the upper piston 20 while the pump is being actuated. It thus goes from its position in which it is in contact with the second shoulder 56, as shown in FIG. 1, to its position in which it comes into contact with the first shoulder 55 of the moving valve member 51. Whereupon the lower piston co-operates with the moving valve member 51 to move it axially inside the pump chamber, by lifting it off its valve seat 52, in order to open the outlet valve 50 and thereby enable the fluid contained in the pump chamber 11 to be delivered. The gap between the shoulders 55 and 56 determines the time of opening of the outlet valve, and thus the volume of the dose to be dispensed. It is necessary merely to modify said gap in order to cause the volume of the dose to vary. The present invention thus makes it very simple and very inexpensive to vary the volume of the dose to be dispensed, merely by modifying a single part of the pump.

As shown in the figures, the inlet valve 40 of the pump chamber 11 includes a valve seat 42 floatingly mounted inside the pump body 10 and urged by a spring into its rest position shown in FIG. 1. The spring 60 is the return spring of the pump. Advantageously, the lower piston 30 is provided with a shoulder which co-operates with said seat of the inlet valve 42 so that, when the outlet valve is opened, the fluid contained in the pump chamber 11 is delivered by means of said lower piston 30, which is returned into its starting position by the spring 60 which acts on the valve seat 42.

In the invention, the lower piston 30 is made separately from the inlet valve seat 42. The advantage of making the lower piston 30 separately is described below with reference to FIG. 2 and in relation to a particular embodiment of the invention.

When the outlet valve 50 is opened, the fluid contained in the pump chamber 11 is thus delivered from said pump chamber, the lower piston rising inside the pump body 10 under drive from the compressed spring 60 until the lower piston 30, or the piece 70 integral with said lower piston 30, comes into abutment again against the second shoulder 56 of the moving valve member 51 of the outlet valve 50 so as to urge said valve member into its closed position. The suction generated in the pump chamber by the fluid being delivered and by the pistons rising opens the inlet valve 40, said ball thus being lifted off its valve seat to enable a new dose of fluid to be sucked into the pump chamber 11.

The invention thus offers two essential advantages. Firstly it guarantees that a dose is delivered in full each time the pump is actuated, by preventing any partial dispensing of the contents of the pump chamber 11. The outlet valve 50 cannot open until a full dose has been metered out, regardless of the actuating force exerted by the user on the pump. Secondly, the accuracy of dose-metering is guaranteed by the outlet valve closing automatically after the dose has been delivered.

Figure 2:
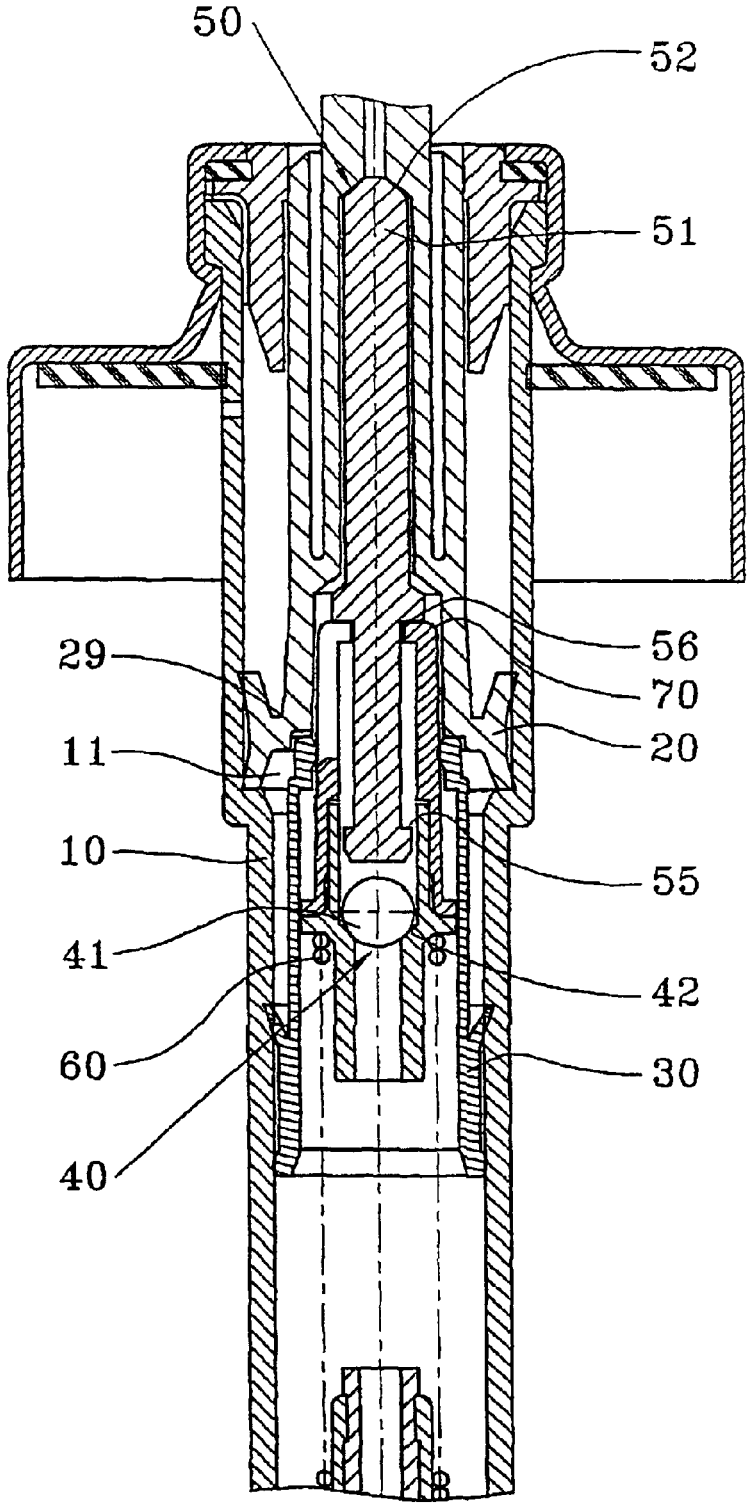
FIG. 2 is a view similar to the view in FIG. 1, in the priming position.

In the invention, the lower piston 30 is made separately from the inlet valve seat 42. By making the lower piston 30 separately from the inlet valve seat 42, and by mounting said lower piston 30 to float inside the pump body, it is possible to use said lower piston as a primer element. As shown in FIG. 2, the first time the pump is actuated, when the pump chamber 11 contains air, the lower piston 30 lifts off from the inlet valve seat 42, because air is compressible, and it generates a passageway through which air can flow out between the lower piston 30 and said inlet valve seat 42, thereby enabling the air contained in the pump chamber 11 to be removed. Air also flows out through a passageway between the lower piston 30 and the upper piston 20 via one or more grooves 29 provided in an end surface of the upper piston 20, and which co-operate(s) with the lower piston 30 at the end of the stroke traveled when the pump is actuated for the first time, as shown in FIG. 2. The groove 29 thus co-operates with the lower piston 30 in a position which makes it possible to limit the dead volume of the pump chamber 11 so that almost all of the air contained in said pump chamber is removed in the position shown in FIG. 2. When the user ceases to press on the pump starting from the position shown in FIG. 2, the entire mechanism of the pump rises under drive from the return spring 60, so that the pump chamber fills with fluid via its inlet valve 40. As soon as the fluid enters the pump chamber 11, said lower piston 30 is urged automatically by the fluid into its position shown in FIGS. 1 and 3, in which position the lower piston 30 co-operates with the valve seat 42 so as to close off said above-mentioned passageway through which air can flow out. Whereupon, said lower piston 30 can no longer lift off from the valve seat 42 because of the presence of incompressible fluid inside the pump chamber 11. When the pump is actuated on subsequent occasions, the lower piston 30 and the valve seat 42 then act as a one-piece unit, providing excellent leaktightness, and preventing any fluid from leaking out through the air removal passageway that serves to prime the pump. Naturally, the embodiment shown in the figures is an advantageous particular embodiment, but it is quite possible to consider providing other primer means for priming the pump, without necessarily using the lower piston for this purpose.

Other modifications may be made by the person skilled in the art without going beyond the ambit of the present invention, as defined by the accompanying claims.

What is claimed is:

1. A fluid dispenser pump comprising a pump body (10) containing a pump chamber (11) defined between an upper piston (20) and a lower piston (30), said pistons (20, 30) being mounted to elide in leaktight manner in said pump body (10), said pump chamber (11) being provided with an inlet valve (40) and with an outlet valve (50), said lower piston (30) co-operating with said outlet valve (50), when the full dose has been metered out, to open said outlet valve and to make it possible to deliver the fluid contained in the pump chamber (11), said dispenser pump being characterized in that the lower piston (30) is separate from inlet valve seat (42) and is mounted to float in the pump chamber (11), said lower piston (30) being returned to its rest position by said inlet valve seat (42).

2. A pump according to claim 1, in which the outlet valve (50) comprises a valve member (51) which is mounted to move in the pump chamber (11) and which is urged into its closure position by pressure from the fluid contained in the pump chamber (11), said moving valve member (51) being provided with a shoulder (55) which, when a full dose has been metered out, co-operates with said lower piston (30) or with an element (70) integral therewith, so that the lower piston (30) lifts the valve member (51) off its valve seat (52) so as to open the outlet valve (50).

3. A pump according to claim 1, in which the outside diameter of the upper piston (20) is larger than the outside diameter of the lower piston (30).

4. A pump according to claim 1, in which the valve seat (42) of the inlet valve (40) is urged by a resilient element (60) into the rest position of the pump, in which position said lower piston (30) or an element (70) integral therewith urges the outlet valve (50) into closure position.

5. A pump according to claim 4 in which the resilient element comprises a spring.

6. A pump according to claim 1, in which said lower piston (30) acts as a primer element for removing the air contained in the pump chamber (11) when the pump is actuated for the first time.

7. A pump according to claim 6, in which, when the pump chamber (11) contains air, an air removal passageway is formed between the lower piston (30), the upper piston (20) and the inlet valve seat (42) so as to enable the air to be removed from the pump chamber (11) said lower piston (30) closing off said air passageway in leaktight manner when the pump chamber (11) contains fluid to be dispensed.

8. A pump according to claim 1, in which the outlet valve member (51) is provided with a second shoulder (56) which co-operates with said lower piston (30) or with an element (70) integral with said lower piston (30), when the pump is in the rest position, so that the lower piston (30) urges said moving valve member (51) into its closure position.

* * * * *